US006109352A

United States Patent [19]

Edwards et al.

[11] Patent Number: 6,109,352

[45] Date of Patent: Aug. 29, 2000

[54] SIMPLIFIED XMAS TREE USING SUB-SEA TEST TREE

[75] Inventors: Jeffrey Charles Edwards, Aberdeen; Michael Graham Morgan, Banff, both of United Kingdom

[73] Assignee: Expro North Sea Limited, Aberdeerm, United Kingdom

[21] Appl. No.: 09/043,780

[22] PCT Filed: Sep. 20, 1996

[86] PCT No.: PCT/GB96/02322

§ 371 Date: Jul. 30, 1998

§ 102(e) Date: Jul. 30, 1998

[87] PCT Pub. No.: WO97/11252

PCT Pub. Date: Mar. 27, 1997

[30] Foreign Application Priority Data

Sep. 23, 1995 [GB] United Kingdom ..... 9519454

[51] Int. Cl.[7] ..... E21B 7/12; E21B 29/12

[52] U.S. Cl. ..... 166/336; 166/86.1; 166/97.1; 166/368

[58] Field of Search ..... 166/336, 368, 166/97.1, 95.1, 86.1, 89.1, 113

[56] References Cited

U.S. PATENT DOCUMENTS

| | | | |
|---|---|---|---|
| 3,426,845 | 2/1969 | Dollison | 166/97.1 X |
| 3,870,101 | 3/1975 | Helmus | 166/368 X |
| 4,103,744 | 8/1978 | Akkerman | 166/324 |
| 4,189,003 | 2/1980 | James et al. | 166/362 X |
| 4,681,133 | 7/1987 | Weston | 166/95.1 X |
| 4,691,781 | 9/1987 | Gano | 166/368 |
| 4,784,225 | 11/1988 | Petersen . | |
| 5,005,650 | 4/1991 | Hopper | 166/339 |
| 5,299,641 | 4/1994 | Paulo et al. | 166/368 X |
| 5,484,022 | 1/1996 | Coutts et al. | 166/336 |
| 5,873,415 | 2/1999 | Edwards | 166/368 X |

FOREIGN PATENT DOCUMENTS

| | | | |
|---|---|---|---|
| 0 671 548 A1 | 10/1992 | European Pat. Off. . | |
| 2 184 508 | 6/1987 | United Kingdom . | |
| 2 267 920 | 12/1993 | United Kingdom . | |
| WO 97/04211 | 2/1997 | WIPO | E21B 33/035 |

OTHER PUBLICATIONS

Robert H. Rothberg et al., "Research Identifies Designs for Lowering Subsea Production Cost", *Oil & Gas Journal*, pp. 45–48, No. 10, 91 (1993) Mar.

*Primary Examiner*—Eileen D. Lillis
*Assistant Examiner*—Jong-Suk Lee
*Attorney, Agent, or Firm*—Pennie & Edmonds LLP

[57] ABSTRACT

An improved sub-sea Xmas tree consists of a wellhead connector, a cylindrical structural housing and a tree cap mounted on top of the housing. A dual bore sub-sea completion test tree is disposed in the housing and it has a main production bore with serial ball valves for controlling fluid flow in the production flow path of an annuus bore with a ball valve therein. The ball valves are independently and remotely actuatable by a remotely operated vehicle (ROV) override system to control communication through the Xmas tree and to comply with various regulatory standards. A cross-over valve is provided between the main bore and the annulus bore to allow fluid passage for well kill operations.

7 Claims, 2 Drawing Sheets

SIMPLIFIED XMAS TREE USING SUB-SEA TEST TREE

THE TECHNICAL FIELD

The present invention relates to sub-sea xmas trees.

BACKGROUND OF THE INVENTION

Traditionally, well testing is conducted using a mono-bore conduit to convey production fluids between the marine wellhead, at the mud line, and the xmas tree/flow head at the surface facilities. Various regulatory bodies require the establishment of two barriers between the reservoir and the environment. A mono-bore sub-sea test tree is used to facilitate pressure control. This test tree contains two separate valves to provide the mandatory barriers in the production fluid flow path in order to enable the well to be closed in. The primary annulus barrier is the production packer and the secondary annulus barrier is provided by the contact of blow-out preventer (BOP) pipe rams, seals with the mono-bore riser. Access into the annulus, between the production tubing and the production casing, is required to enable the annulus pressure to be monitored and to be adjusted as necessary. In the traditional systems the annulus flow path is vertical up to the isolation point at which the blow-out preventer (BOP) stack pipe ram seals contact the mono-bore riser. The vertical passage of annulus fluid is blocked at the aforementioned seal and the fluid passage to surface is via a hydraulically actuated valve of the BOP system into external choke or kill lines which are attached to the BOP stack and the marine riser.

U.S. Pat. No. 4,784,225 discloses a well valve assembly for the control of well fluids that flow in the tubing and annulus.

SUMMARY OF THE INVENTION

This structure is not a sub-sea xmas tree and does not operate as a xmas tree.

It is desirable to provide an improved sub-sea xmas tree which avoids the requirement of an expensive xmas tree construction or of the requirement of a BOP stack above the xmas tree to provide annulus barriers.

This is achieved by using a dual bore sub-sea test tree as a simple sub-sea xmas tree whereby the sub-sea test tree provides both a flow path for production fluids and an annulus flow path with the mandatory barriers required.

The dual bore sub-sea test tree contains two ball valves in the production fluid flow path and one or more ball valves in the annulus fluid flow path and thereby fulfils the required regulatory safety standards.

The simplified sub-sea xmas tree comprises three principal components: a wellhead connector, a valve block coupled to the wellhead connector and tree cap coupled to the top of the valve block. The valve block of the sub-sea xmas tree is obtained by securing and sealing the dual bore sub-sea completion test tree inside a cylindrical structural housing. At the lower end the housing is attached to the suitable sub-sea wellhead connector to enable the assembly to be secured to a sub-sea wellhead and is provided with a suitable wellhead profile at the top for attachment of an external tree cap which enables the flow line and control umbilical to be attached to the tree.

ROV (Remotely Operated Vehicle) override units are coupled to each valve mechanism thereby allowing each valve to be actuated between an open and closed position by an ROV.

According to a first aspect of the present invention there is provided a sub-sea xmas tree comprising, a wellhead connector, valve block means coupled to the wellhead connector and to a tree cap, said valve block means consisting of a housing which is generally cylindrically in shape defining a generally cylindrical interior and a dual bore sub-sea completion tree disposed within said housing, the sub-sea completion tree having a main production bore and an annulus bore substantially parallel to said main production bore, said annulus bore and said main bore extending from one end of the said completion tree to the other end, at least two valve elements disposed in series in said main bore and at least one valve element being disposed in said annulus bore, each of said valve elements being actuatable to move between an open and a closed position to allow fluid communication through said respective bores or to seal said bores, a tree cap adapted to be coupled to the upper end of said housing by an upper connector, said upper connector including communication means for facilitating communication to the annulus and production bores to allow communication and control of various operations, ROV override means, coupled to said communication means, for allowing a ROV to override normal valve control of said valve elements to move said elements between an open and a closed position.

Preferably, the sub-sea completion tree is a dual bore sub-sea test tree (SSTT) with two ball valves disposed in said main bore in a spaced apart position along the length of the bore and two ball valves disposed in said annulus bore and spaced apart along the length of the bore.

Preferably, the sub-sea completion tree has four ROV override units spaced around the tree, each ROV unit being coupled to a respective valve element for overriding the normal hydraulic valve operation and actuating the valve to move between the open and closed position. Conveniently, each ROV override mechanism includes a rotatable shaft coupled to a pinion which engages in a rack which, in turn, is coupled to an annular or axial segment which carries a pin which engages the valve operating mechanism and when the shaft is rotated by the ROV, the pinion drives the rack and annular segment axially to force the pin to urge the valve to a locked open position. Reversing the direction of rotation of the shaft moves the valve back to the closed position.

Installation procedures for the simplified sub-sea completion test tree are similar to those used to run conventional dual bore sub-sea systems. In particular, in conjunction with the dual bore sub-sea test tree, a dual bore riser is required for the installation of the tubing hanger into the sub-sea wellhead thereby providing two independent lines for the deployment of wireline installed barriers in the production and annulus flow paths. For applications in deep water where gas is present, it may be necessary to run a retainer valve in the string immediately above the sub-sea test tree to prevent sudden release of high pressure gas into the marine riser with the consequential possibility of collapsing the marine riser in the event of an emergency disconnection or the lower marine riser package (LMRP) from the BOP stack. Once the wireline plugs have been installed and tested, the BOP stack is retrieved after which the tree assembly is run. In normal practice, the sub-sea completion xmas tree is run on a dual bore riser system including a quick-disconnect package which provides the conduits necessary for the retrieval of wireline plugs and accommodates the need for emergency disconnections.

The upper profile of the tree structural housing fits an 18¾" (47.63 cm) wellhead connector. This enables the tree to be run using part or all of the LMRP in conjunction with a dual bore intervention system, as disclosed in applicant's published International Application W097/04211, which comprises a safety package, an emergency disconnect package, a suitable quantity of dual bore riser joints, a lubricator valve, a tension joint, a cased wear joint at the interface with rotary table, a surface xmas tree with adaptor joint and suitable controls, power packs, panels and umbilicals. It will be understood that the presence of the lubricator valve obviates the need for a lubricator stack above the surface xmas tree.

According to another aspect of the present invention, there is provided an ROV mechanism for use with sub-sea xmas trees having at least one valve required to be remotely actuated by an ROV, said mechanism comprising, at least one ROV coupling means connected to the sub-sea tree, said ROV coupling means having a housing within a rotatable shaft therein, valve actuation means coupled to the valve mechanism and to said rotatable shaft, means for converting said rotating movement of the rotating shaft to rectilinear movement whereby as the shaft is rotated by an ROV, the valve actuation means is moved linearly to actuate the valve between an open and a closed position.

Conveniently, the means for converting rotating movement of the rotating shaft to rectilinear movement is a rack and pinion arrangement, a toothed pinion wheel being mounted on the end of the shaft and an end of said valve actuation means having a toothed slot for engagement with the pinion wheel and moveable in response to rotation of the pinion wheel.

Alternatively, the means for converting rotating movement to rectilinear movement is a worm and pawl drive.

BRIEF DESCRIPTION OF THE DRAWINGS

These and other aspects of the invention will become apparent from the following description when taken in combination with the accompanying drawings in which.

DETAILED DESCRIPTION OF THE INVENTION

Figure 1:
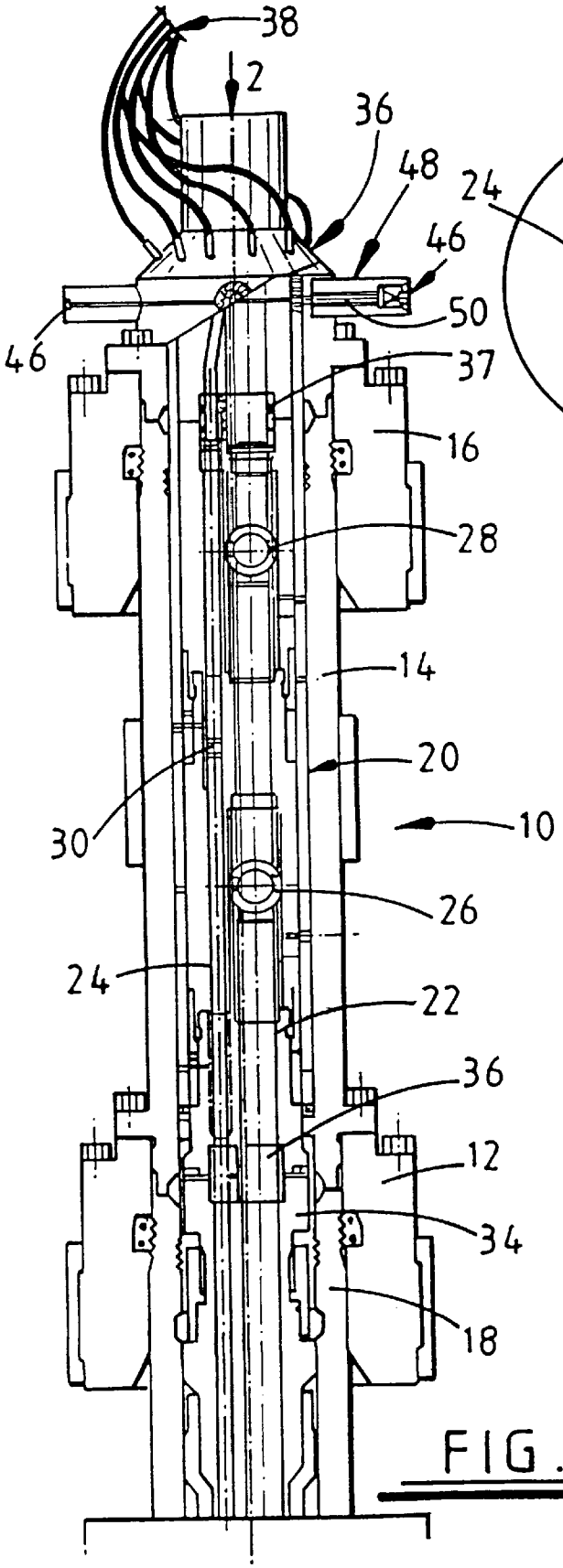
FIG. 1 is an elevational and part-sectional view through a simplified sub-sea xmas tree using a sub-sea test tree in accordance with an embodiment of the present invention.

Reference is first made to FIG. 1 of the drawings which depicts a simplified sub-sea xmas tree using the sub-sea completion tree. The xmas tree is generally indicated by reference numeral 10 and consists of a wellhead connector 12, a cylindrical structural housing 14 coupled to the wellhead connector 12 and a tree cap 16 which is coupled to the top of cylindrical housing 14. In the drawing it will be seen that the sub-sea wellhead connector 12 is coupled to an 18¾" (47.63 cm) sub-sea wellhead 18 using a standard cam ring and dog connection. Similarly, the tree cap 16 is coupled to the top of the structural housing 14 using a similar mechanism.

A completion sub-sea test tree, generally indicated by reference numeral 20, is disposed in the structural housing 14 as shown. The completion tree is substantially as that disclosed in applicant's co-pending granted U.S. Pat. No. 5,873,415 and which has been used in the field. The sub-sea completion tree has a main (for example 5" (12.70 cm)) production bore 22 and an annulus bore (for example 2" (5.08 cm)) 24. Two ball valves 26 and 28 are disposed in series in the main production bore and a single smaller ball valve 30 is disposed in the annulus bore. The ball valves, as will be described, are independently actuatable hydraulically and by an ROV (Remotely Operated Vehicle) override system to open and close thereby sealing the production and annulus bores as appropriate to provide communication through the bores or to seal the bores so as to facilitate various operations to be carried out on the reservoir.

It will be seen that within the wellhead 18 a proprietary tubing hanger 34 is located. The completion sub-sea test tree 20 carries an adaptor 36 which couples the production and annulus bores to the tubing hanger thereby providing continuous production bore and annulus bore communication with the annulus bore being separated from the production bore. A similar adaptor 37 is disposed at the upper end of the sub-sea completion tree 20.

The tree cap 16 is attached to the tree structural housing 14 by the upper connector which is substantially identical to wellhead connector 12 and which includes receptacles 36 for receiving communication conduits 38 for controls, chemical injection, annulus monitoring and production/injection fluids. This also facilitates the connection of the flexible flow line and the control umbilical (not shown in the interest of clarity) to the structural housing 14.

Figure 2:
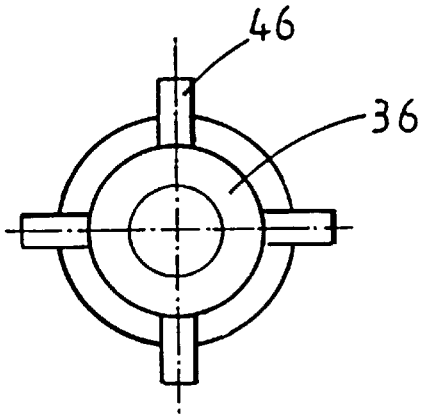
FIG. 2 is a top view of the dual bore xmas tree of FIG. 1 showing four ROV override units.

As best seen in FIG. 2, the receptacle 36 has four ROV valve control units 46 spaced at 90° intervals around the tree for ROV override control of each of valves 26,28 and 30.

Figure 3:
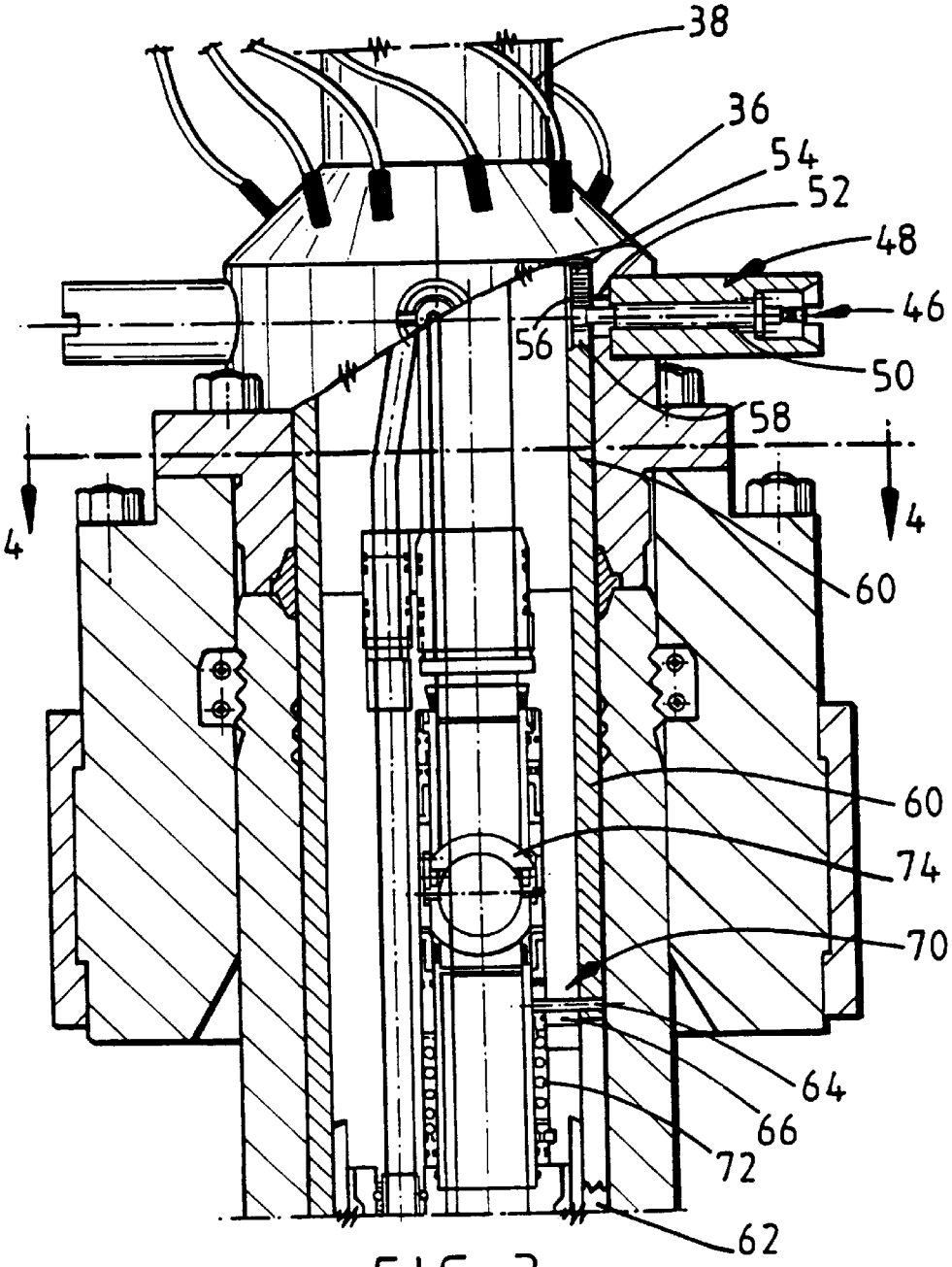

Reference is now made to FIG. 3 of the drawings, showing a part sectional view through one of the ROV override units 46. Only one will be described in detail but it will be understood that the operating mechanism is the same in each case. The override unit 46 consists of a rotatable shaft housing 48 secured to communication means 36 and receives a rotary shaft 50 which is journalled in bearings 52. The shaft 50 is connected to a pinion gear wheel 54 which engages with an internally machined rack 56 which is formed in a slot 58 of an annular segment 60 which extends part-way around annular chamber 62. There is an annular segment associated with each ROV override unit 46 and each respective valve with the segments being of different lengths, as will be described, in order to operate its respective valve mechanism. The upper section of the annular segment is retained in the tree cap by a slot and pin (not shown) which allows limited axial movement of the segment within annular chamber 62. The lower portion of the annular segment 60 engages a pin 64 which passes through a slot 66 in a sleeve 70 surrounding the valve mechanism 28. When an ROV engages the unit 46 and rotates the rotary drive shaft 50, it rotates the pinion 54 which causes the rack 56 and segment 60 to move downwards within the annular chamber 62. This forces the pin 64 to move down within slot 66 and urges the ball operator mechanism downwards against coil spring 72 and moves the ball element 74 through 90°, by a camming action, into a locked open position. To unlock the valve and return it to the closed position, shown in FIG. 2, the rotation of the shaft 50 is simply reversed.

It will be understood that the annular segments require to be of suitable lengths so that the pins carried at the bottom engages the appropriate mechanism of valves 26, and 30. It will be appreciated that the ROV override units are surrounded by an ROV docking frame (not shown in the interest of clarity) for receiving the ROV to facilitate engagement with the units 46 and the docking frame identifies the particular ROV units of each valve in the main bore and annulus bore.

Various modifications may be made to the embodiment hereinbefore described without departing from the scope of the invention. For example, it will be understood that the valves in the completion sub-sea test tree within the xmas tree may be replaced by flapper valves, plug valves or the like and, in addition, a single valve may be located within the annulus bore on the completion sub-sea test tree, the primary annulus seal being the production packer of the xmas tree.

In addition, two series valves may be used in the annulus bore to provide a secondary annular barrier to the downhole packer. In this case the sub-sea test tree will be slightly longer to accomodate a second valve in the annulus bore.

Figure 4:
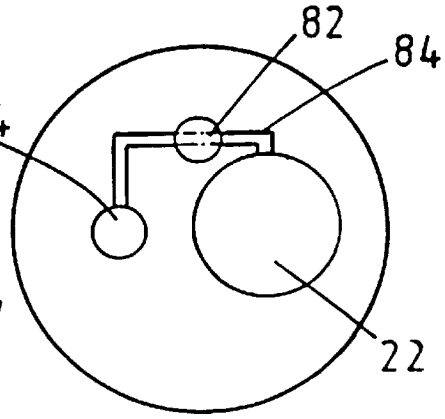
FIG. 3 is an enlarged view of the top part of FIG. 1 and showing in more detail an ROV overrideable mechanism used to control the valve operation of the sub-sea xmas tree and FIG. 4 is a sectional new taken on the line 4—4 of FIG. 3 and showing the cross-over port and ball valve for providing communication between the production bore and annulus bore.

In addition as shown in FIG. 4, the major and minor bores may be interlinked via a cross port 84 and isolated by an additional cross-over ball valve 82 to provide communication between the bores to allow passage of kill fluids for well kill operations. Typically this may be achieved by locating the cross-over valve 82 in the tree cap 16 and circulating well kill fluid from the riser or a separately connected service line in the event that the flow path through the production route was undesireable or unavailable. The cross-over valve could be located in the main valve block or test tree 20.

The main advantage of the present invention is that the function of a xmas tree can be carried out using a dual bore sub-sea test tree which provides a separate production bore and an annulus bore and which provides the mandatory barriers in the production bore and annular bore flowpaths, thus greatly minimising the speed of installation, and hence cost, and being relatively easy to control. In addition, the provision of ROV override mechanisms allows independent ROV operation of each valve thereby complying with regulatory requirements.

What is claimed is:

1. A sub-sea Xmas tree comprising, a wellhead connector, valve block means coupled to the wellhead connector and to a tree cap said valve block means consisting of a housing which is generally cylindrical in shape defining a generally cylindrical interior and a dual bore sub-sea completion tree disposed within said housing, the sub-sea completion tree disposed within said housing, the sub-sea completion tree having a main production bore and an annulus bore substantially parallel to said main production bore, said annulus bore and said main bore extending from one end of the said completion tree to the other end, at least two valve elements disposed in series in said main bore and at least one valve element being disposed in said annulus bore, each of said valve elements being actuatable to move between an open and a closed position to allow fluid communication through said respective bores or to seal said bores, the tree cap adapted to be coupled to an upper end of said housing by an upper connector, said upper connector including communication means for facilitating communication to the annulus and production bores to allow communication and control of various operations, ROV override means, coupled to said communication means, for allowing overriding of normal valve control of said valve elements to move said valve elements between said open and said closed position.

2. The sub-sea Xmas tree as claimed in claim 1 wherein the valve elements are ball valves and wherein said dual bore completion tree has two ball valves disposed in said main bore in a spaced apart position along the length of the bore and two ball valves disposed in said annulus bore and spaced apart along the length of the bore.

3. The sub-sea Xmas tree as claimed in claim 1 wherein the valve elements are ball valves.

4. The sub-sea Xmas tree as claimed in claim 1 wherein the main production bore is coupled to the annulus bore by a cross-port, said cross-port having a valve located therein to provide communication between the bores to allow passage of fluids for well kill operations.

5. The sub-sea Xmas tree as claimed in claim 1 further comprising a cross-over valve locate in the tree cap.

6. The sub-sea Xmas tree as claimed in claim 1 wherein the ROV override means comprises four ROV override units spaced around the sub-sea tree, each ROV override unit being coupled to a respective valve element for overriding the normal hydraulic valve operation and actuating the valve to move between the open and closed position.

7. The sub-sea Xmas tree as claimed in claim 6 wherein each ROV override unit includes a rotatable shaft coupled to a pinion which engages in a rack which, in turn, is coupled to an annular or axial segment which carries a pin which engages the valve operating mechanism and when the shaft is rotated, the pinion drives the rack and annular segment axially to force the pin to urge the valve to a locked open position.

* * * * *